US007828063B2

(12) United States Patent
Olsen et al.

(10) Patent No.: US 7,828,063 B2
(45) Date of Patent: Nov. 9, 2010

(54) ROCK STRESS MODIFICATION TECHNIQUE

(75) Inventors: Tom Olsen, Parker, CO (US); Tom R. Bratton, Littleton, CO (US)

(73) Assignee: Schlumberger Technology Corporation, Sugar Land, TX (US)

( * ) Notice: Subject to any disclaimer, the term of this patent is extended or adjusted under 35 U.S.C. 154(b) by 78 days.

(21) Appl. No.: 12/419,352

(22) Filed: Apr. 7, 2009

(65) Prior Publication Data

US 2009/0266548 A1 Oct. 29, 2009

Related U.S. Application Data

(60) Provisional application No. 61/047,185, filed on Apr. 23, 2008.

(51) Int. Cl.
*E21B 47/00* (2006.01)

(52) U.S. Cl. ..... 166/308.1; 166/177.5

(58) Field of Classification Search ..... 166/308.1, 166/177.5

See application file for complete search history.

(56) References Cited

U.S. PATENT DOCUMENTS

| | | | | |
|---|---|---|---|---|
| 3,050,118 | A * | 8/1962 | Elkins | 166/297 |
| 4,149,409 | A | 4/1979 | Serata | |
| 4,442,697 | A | 4/1984 | Jones et al. | |
| 5,050,690 | A | 9/1991 | Smith | |
| 5,074,359 | A | 12/1991 | Schmidt | |
| 5,353,637 | A | 10/1994 | Plumb et al. | |
| 5,482,116 | A | 1/1996 | El-Rabaa et al. | |
| 5,511,615 | A | 4/1996 | Rhett | |
| 5,576,485 | A | 11/1996 | Serata | |
| 6,929,066 | B2 | 8/2005 | Hill | |
| 7,096,943 | B2 | 8/2006 | Hill | |
| 7,395,859 | B1 | 7/2008 | Hill | |
| 2008/0142219 | A1 * | 6/2008 | Steele et al. | 166/281 |

FOREIGN PATENT DOCUMENTS

| | | |
|---|---|---|
| WO | 03056131 | 7/2003 |

* cited by examiner

*Primary Examiner*—William P Neuder
(74) *Attorney, Agent, or Firm*—David Cate; Robin Nava; Jeff Griffin

(57) ABSTRACT

A technique involves facilitating fracturing operations along a wellbore extending through a subterranean formation. A stress device is deployed in a wellbore and activated to engage a surrounding wall. The stress device can then be manipulated to create a reduced stress region in the formation at a desired location along the wellbore. The reduced stress region facilitates the controlled formation of a fracture in the formation at the desired location. Furthermore, the stress device can be moved and the process repeated at multiple locations along the wellbore.

16 Claims, 5 Drawing Sheets

ROCK STRESS MODIFICATION TECHNIQUE

CROSS-REFERENCE TO RELATED APPLICATION

The present document is based on and claims priority to U.S. Provisional Application Ser. No. 61/047,185, filed Apr. 23, 2008.

BACKGROUND

In many low permeability oil and gas producing formations, wells are formed by drilling wellbores that curve to a generally horizontal orientation. The horizontal section of the wellbore is positioned to extend through the target formation containing oil or gas hydrocarbons. In many cases, the best production can be achieved by drilling horizontally in the direction of the minimum horizontal stress of the rock/formation and then creating propped hydraulic fractures along the horizontal section of the wellbore. However, the practical implementation of multiple transverse propped fractures along a horizontal section of the wellbore can be problematic and expensive. As a result, the number of actual transverse fractures created is usually less than the optimal number indicated by production simulation models.

With respect to current completion practices for horizontal wells, several different approaches are used. For example, some applications employ cased and cemented completions that use perforations to connect the wellbore with the surrounding formation. However, the cement can damage natural fractures, and initiation of transverse fractures from the perforations can create multiple and complex fracturing. Such fracturing creates problems with respect to placement and constriction during hydrocarbon production. Additionally, the approach requires multiple trips into the wellbore for perforating each stage which adds to the time and expense of the operation.

In another application, open hole completions are used without cement, but these types of completions provide very little control for creating multiple induced transverse fractures and often result in the formation of a single fracture across the entire horizontal section of the wellbore. In other applications, open hole packer systems and isolation devices are used to create some degree of isolation that can enable multiple stages to be created. However, the practical number of transverse fractures is limited, and the required hardware is complicated and expensive. In some applications, the hardware assemblies are prone to becoming stuck in the wellbore before being properly placed, or the systems have difficulty in holding pressure effectively.

SUMMARY

In general, the present invention provides a methodology and system for facilitating fracturing operations along a wellbore extending through a subterranean formation. A stress device is deployed downhole into a wellbore and activated to engage a surrounding wall. The stress device is manipulated to create a reduced stress region in the formation at a desired location along the wellbore. The reduced stress region facilitates the controlled formation of a fracture in the formation at the desired location. The stress device can be moved and the process repeated at multiple locations along the wellbore.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
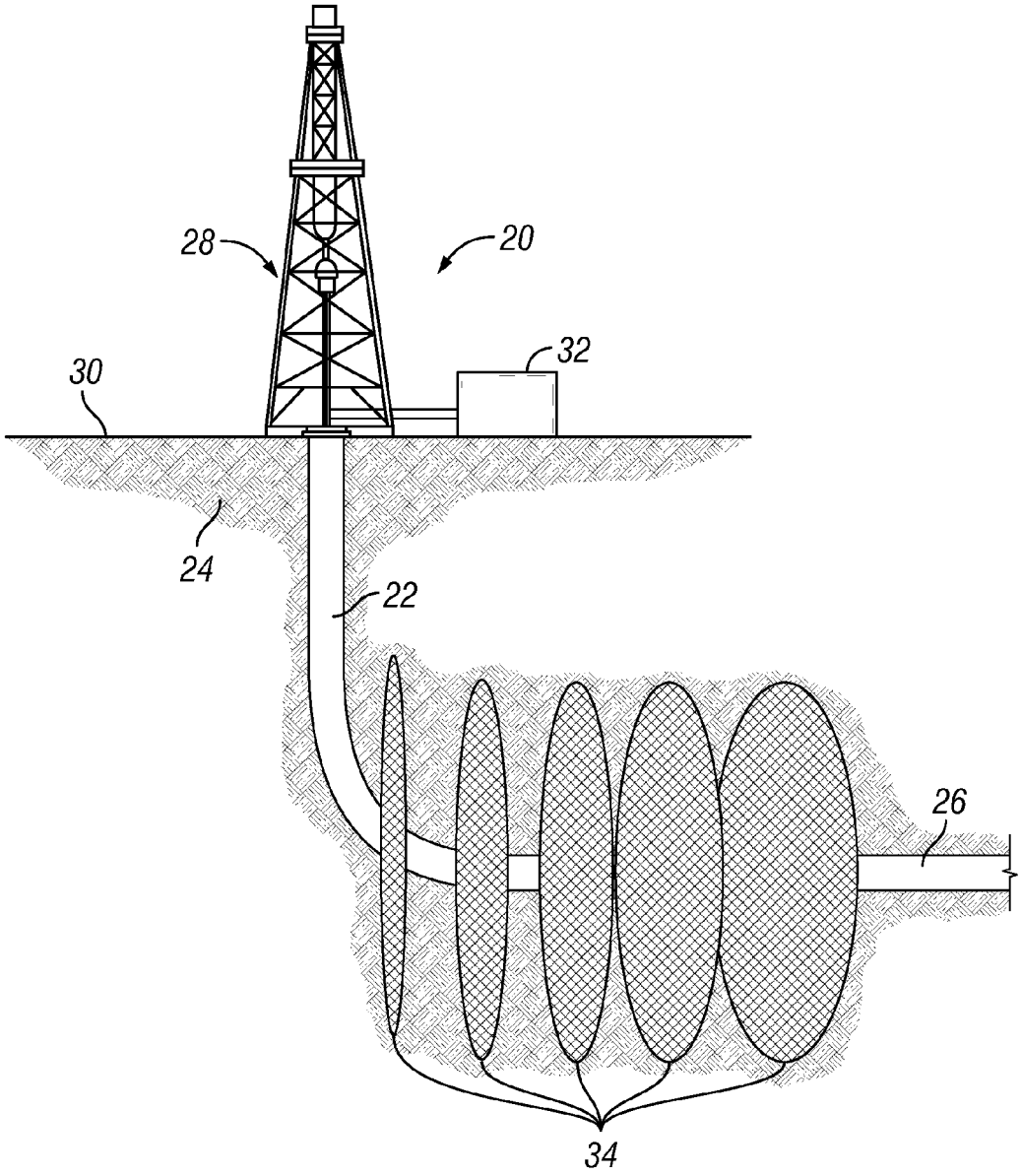
FIG. 1 is a schematic front elevation view of a well system for use in a wellbore to facilitate a fracturing procedure, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a methodology and system for performing a well treatment operation, such as a fracturing operation. The technique enables precise control over orthogonal fracture initiation points along a wellbore, e.g. a horizontal subsurface wellbore, by manipulating the minimum horizontal stress on the rock/formation adjacent to the wellbore. In some applications, the manipulation can be accomplished from the surface via tubing, such as continuous pipe or jointed pipe. In open hole horizontal wellbores, for example, the technique enables multiple fractures to be staged along the horizontal section of the wellbore without requiring expensive and complicated open hole packer assemblies. In cased and cemented horizontal sections of wellbores, the technique also enables multiple fractures to be staged but without isolation plugs. As a result, the multiple fracture complexities that often cause fracture placement failures and create flow constrictions during oil or gas production are reduced or eliminated.

According to one embodiment, the technique involves a device that can be used to manipulate stresses in the rock/formation adjacent to a wellbore section, e.g. a horizontal wellbore section, to induce initiation of a hydraulic fracture at a specific, desired location. The device can be selectively moved along the wellbore and reset at any desired location along the wellbore to create as many transverse fractures as desired. The device enables precise control over creating transverse fractures to optimize stimulation of a formation surrounding, for example, a horizontal wellbore to maximize oil and/or gas production. The induced fracture stages can be completed sequentially right after one another without requiring separate trips in and out of the wellbore between stages. As a result, the number of induced, orthogonal fractures can be placed much faster and at a greatly reduced cost. In many environments, the increased number of orthogonal, induced fractures greatly improves the productivity of the well.

The precise control of induced fracture placement also enables identification of natural fracture swarms along a horizontal wellbore section via detection logs, such as FMIs and the Sonic logs. The identification information can then be used to precisely place induced propped fractures at appropriate locations in the natural fracture swarms to optimize the productive potential.

In many types of environments and applications, a stress inducing and fracturing procedure can be conducted as follows: Initially, the stress device is delivered downhole on tubing, such as continuous/coiled tubing or jointed tubing. The stress device is then manipulated to affect the stresses in the surrounding rock formation in a manner that enables the precise initiation of induced hydraulic fractures at specific, desired locations along the wellbore, e.g. along a horizontal section of the wellbore. Following the fracture stimulation treatment, the stress device is unset and moved along the wellbore until it is reset at the next subsequent, desired location to induce a second fracture in the formation. The stress device can be repeatedly disengaged and reengaged at multiple desired locations to enable multiple fracture stimulations that create multiple fractures at specific, desired locations along the wellbore to better optimize fluid production from the formation.

Referring generally to FIG. 1, one embodiment of a well system 20 is illustrated as performing a well treatment operation, e.g. fracturing operation, along a wellbore 22. The wellbore 22 is formed through a subterranean formation 24, sometimes referred to as a rock formation, and may include a horizontal section 26. As illustrated, the wellbore 22 extends down into formation 24 from surface equipment 28, e.g. a rig, positioned at a surface location 30. The well system 20 further includes a treatment system 32 which, in the illustrated embodiment, comprises a fracturing system. The fracturing system 32 is used to facilitate the precise formation of fractures 34 along a desired section of the wellbore 22, as explained in greater detail below. By way of example, well system 20 may be used to create multiple orthogonal or transverse fractures 34 along the horizontal section 26 of wellbore 22 to facilitate the production of a desired fluid from the surrounding formation 24.

Figure 2:
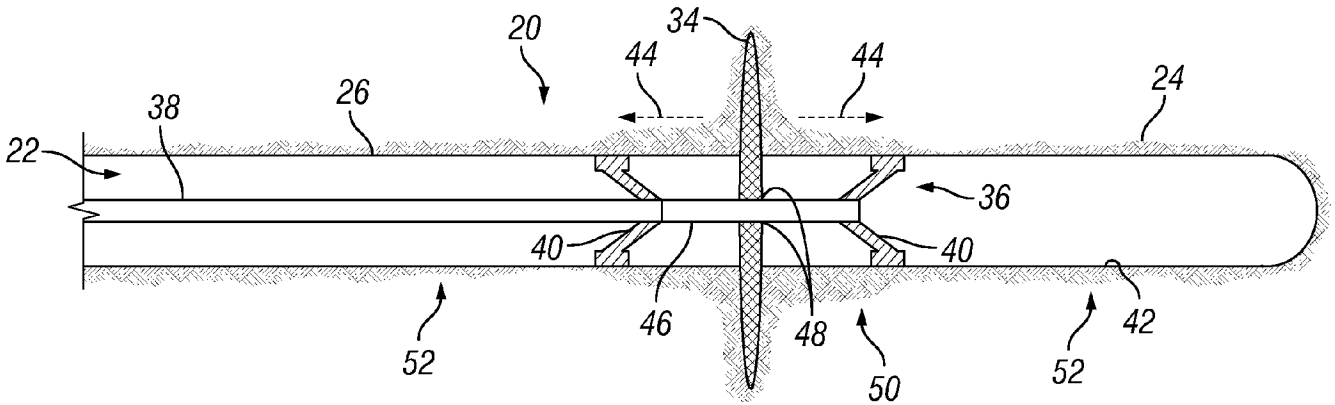
FIG. 2 is a schematic front elevation view of the well system employing one embodiment of a stress device to create a reduced stress region in a formation, according to an embodiment of the present invention.

Referring generally to FIG. 2, one embodiment of well system 20 is illustrated in which a stress inducing device 36 is delivered downhole into wellbore 22 to facilitate the precise formation of fractures 34 at desired sequential locations along wellbore 22. For example, the stress device 36 can be used to create multiple transverse fractures 34 along horizontal section 26 of wellbore 22. The stress device 36 is delivered downhole on a suitable conveyance 38, such as continuous tubing, e.g. coiled tubing, or jointed pipe. Depending on the configuration of well system 20, tubing conveyance 38 or its surrounding annulus can be used to deliver fracturing fluid/proppant for creation of the desired transverse fractures 34.

As illustrated, stress device 36 comprises a pair of device mechanisms 40 that can be selectively actuated to a radially outward configuration in which the device mechanisms 40 securely engage a surrounding wellbore wall 42, as illustrated in FIG. 2. The surrounding wellbore wall 42 may comprise an open wellbore section, a casing, or another type of wellbore wall. Device mechanisms 40 may have a variety of structures, but the illustrated example utilizes opposing anchors or slips that can be actuated to securely engage and grip the surrounding wellbore wall 42.

Once engaged, the device mechanisms 40 apply opposing forces to the surrounding wellbore wall 42 and surrounding formation 24, as indicated by arrows 44. The stress device 36 can be manipulated to apply the opposing forces via an actuator 46 connected to device mechanisms 40. The actuator 46 may comprise a hydraulic actuator, mechanical actuator, electric actuator, or other suitable actuator able to apply desired forces to the mechanisms 40 once mechanisms 40 are engaged with the surrounding wellbore wall 42. For example, the stress device 36 can be elongated between opposing slips or anchors to create the opposing forces indicated by arrows 44. During application of the opposing forces, fracturing fluid is delivered downhole through conveyance 38 or the surrounding annulus. The fracturing fluid is then directed to the formation 24 between device mechanisms 40 via ports 48 positioned at appropriate locations in device 36. The pressurized fracturing fluid creates and grows the transverse fracture 34. After creation of fracture 34, device mechanisms 40 are released, and stress device 36 is moved via conveyance 38 to the next sequential, desired locations where the process is repeated.

Figure 3:
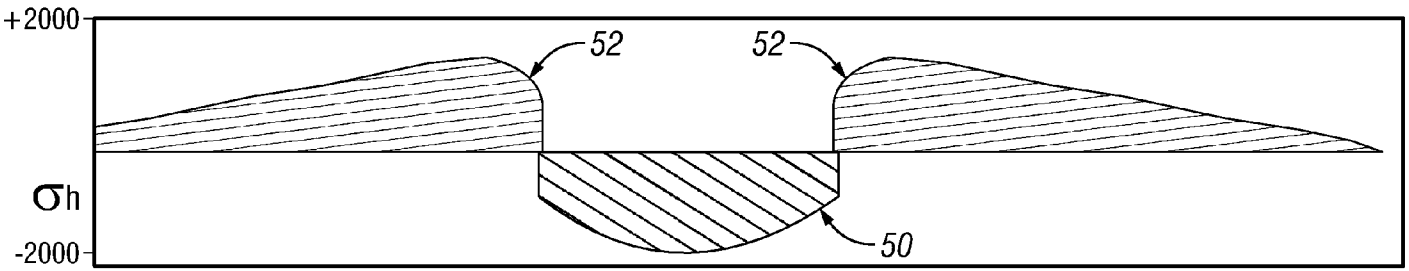
FIG. 3 is a graphical illustration of reduced stress and increased stressed regions along a section of the wellbore, according to an embodiment of the present invention.

In the example illustrated, the creation of opposing forces by stress device 36 causes a tension on the rock formation that significantly reduces the horizontal stress adjacent a specific location along the horizontal section 26 of wellbore 22. The stress manipulation by the opposing device mechanisms 40 is directed perpendicularly to the horizontal section 26 of wellbore 22 to create a reduced stress region 50, as illustrated by the graphical representation of FIG. 3. The reduced stress region 50 is located in the rock formation 24 generally between planes running through device mechanisms 40 perpendicularly to horizontal wellbore section 26. The opposed movement of device mechanisms 40 also creates a higher than normal stress in the regions downhole and uphole of the opposing device mechanisms 40. For example, higher stress regions 52 are illustrated in the graph of FIG. 3 as located in the rock formation 26 uphole and downhole of device mechanisms 40 and reduced stress region 50.

The higher than normal stress uphole and downhole of the opposing device mechanisms 40 combined with the reduced stress region 50 therebetween, enables precise initiation of an induced hydraulic fracture orthogonal to the horizontal wellbore section 26 in the reduced stress region 50 between device mechanisms 40. The stress manipulation of the surrounding rock formation also prevents formation of unwanted fractures anywhere else along the wellbore. The magnitude of the stress manipulation to ensure the induced fracture initiates at the desired location along the wellbore can vary depending on the application and environment. By way of example, the magnitude of the stress manipulation can be as little as a few hundred psi up to or more than ten thousand psi depending on the existing stresses within the formation.

In one operational example, the dual slip/anchor device 36 is delivered downhole into an open hole horizontal section 26 of the wellbore. The stress device 36 is then set by actuating the opposing mechanisms 40 radially outward against the surrounding formation 24. Actuator 46 is then operated to create forces on the surrounding formation that induce opposed horizontal stresses in the rock, as described above.

Fracturing fluid is pumped down through conveyance tubing 38 or down through the surrounding annulus and then out through ports 48 to create a transverse fracture. The location of the fracture is precisely controlled because of the reduced stress region 50 created between higher stress regions 52, and the induced fracture grows orthogonally or transversely with respect to the wellbore section 26. After formation of fracture 34, the stress device 36 is un-set/disengaged and pulled back uphole by conveyance 38 to the next desired location for creation of a subsequent transverse fracture. The stress device 36 is then reset/reengaged and the stress manipulation and fracturing operation is repeated to create a second transverse fracture stimulation at a precise, desired location. The process is repeated as many times as desired along the horizontal wellbore section 26.

Figure 4:
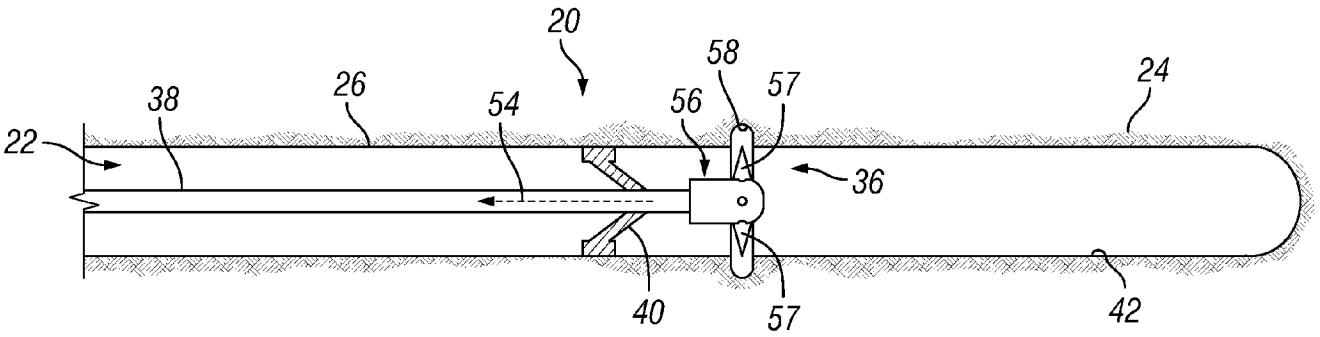
FIG. 4 is a schematic front elevation view of the well system employing another embodiment of the stress device to create a reduced stress region in a formation, according to an embodiment of the present invention.

An alternate embodiment of well system 20 is illustrated in FIG. 4. In this embodiment, stress device 36 also is designed to manipulate downhole stresses in formation 24 to enable initiation of induced fractures at precise, desired locations. However, stress device 36 utilizes a single device mechanism 40, which may be in the form of a single set of retractable anchor arms or retractable slips. The device mechanism 40 is actuated between a radially contracted position and a radially expanded position in which it is engaged with surrounding wellbore wall 42, as illustrated. The surrounding wellbore wall 42 may be an open hole wellbore wall or another type of wellbore wall, such as a wall of a cased and cemented section of wellbore. In the embodiment illustrated, the stress device 36 is again used in horizontal section 26 of wellbore 22.

Figure 5:
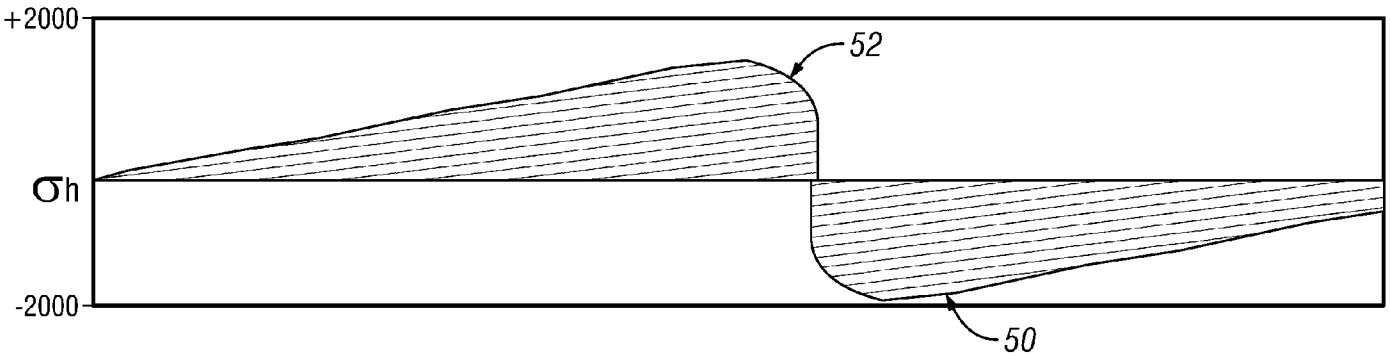
FIG. 5 is a graphical illustration of reduced stress and increased stressed regions along a section of the wellbore, according to an embodiment of the present invention.

Once the device mechanism 40 is actuated to the engaged configuration, the reduced stress region 50 is created by applying an axially directed force to the device mechanism. By way of example, force may be applied to device mechanism 40 by pulling on the device mechanism with conveyance 38, e.g. tubing, in the direction of arrow 54. Pulling on mechanism 40 causes the reduced stress region 50 to form on a downhole side of mechanism 40 and causes the higher stress region 52 to form on the uphole side of mechanism 40, as illustrated in FIG. 5. Formation of the reduced stress region 50 again enables precise placement of transverse fractures at desired locations along wellbore 22.

As further illustrated in FIG. 4, the stress device 36 also may comprise a jetting tool 56, such as a rotary jetting tool, that may be positioned at an end of the tubing forming conveyance 38. In operation, the stress device 36 is placed at a region of wellbore 22 to be fractured. Jetting fluid is then pumped down through tubing, such as the tubing forming conveyance 38, into jetting tool 56, and out through one or more jetting nozzles 57. The jetting fluid may comprise an abrasive, such as sand, to facilitate the jetting operation. If the section of wellbore is an open hole section, the jetting tool 56 is used to direct the jetting fluid and abrasive against the wall of the open hole section to create a circular notch 58 in the formation/rock. The notch creates a natural weak point and overcomes the hoop stress around the wellbore to aid in causing the induced hydraulic fracture to initiate at the notch. If the section of wellbore is a cased hole well section, the jetting tool 56 can be used to cut through the casing in a circle, penetrate through the cement, and further create the notch 58 in the surrounding formation. One example of a jetting tool that can be used in the stress device 36 is the Jet Blaster tool available from Schlumberger Corporation of Houston, Tex., US.

Once the notch 58 is formed, device mechanism 40, e.g. retractable anchor arms or slips, is actuated against the surrounding wellbore wall 42 on an uphole side of notch 58. The stress in the formation at that particular region is then manipulated by applying tension via tubing 38 which can be pulled from a surface location. Again, the tension applied can vary substantially from, for example, a few hundred psi to ten thousand or more psi depending on the existing stresses within the formation. The tension is selected to ensure the induced fracture initiates at the desired location.

In an open hole wellbore, the applied tension is transmitted to the formation 24 directly via device mechanism 40. However, in a cased and cemented wellbore, tension is transferred by pulling on the casing which transfers the forces to the rock formation via the cement surrounding the casing. The cement effectively attaches the casing to the rock surrounding horizontal wellbore section 26.

The applied tension alters the horizontal stress of the formation around the wellbore section 26, effectively causing a reduction of the horizontal stress immediately past or downhole of the device mechanism 40 while causing an increase in horizontal stress immediately uphole of the mechanism 40. This modification to the horizontal stresses alters the fracture initiation pressure, effectively reducing the fracture pressure around the area of notch 58 while increasing the fracture pressure in the region uphole of notch 58. While stress device 36 is in tension, a fracture treatment is pumped downhole via fracturing system 32 through, for example, the annulus between the wellbore wall and tubing 38. The fracturing fluid is directed through device 36 via suitable passages or ports 48, as described above with respect to the embodiment illustrated in FIG. 2. The modification of formation stresses by stress device 36 causes the fracture to initiate in the reduced stress region 50 while limiting or preventing the formation of fractures in any other locations along the horizontal wellbore section 26. Use of jetting tool 56 to create notch 58 further facilitates the precise placement of a desired transverse fracture along the wellbore.

Figure 6:
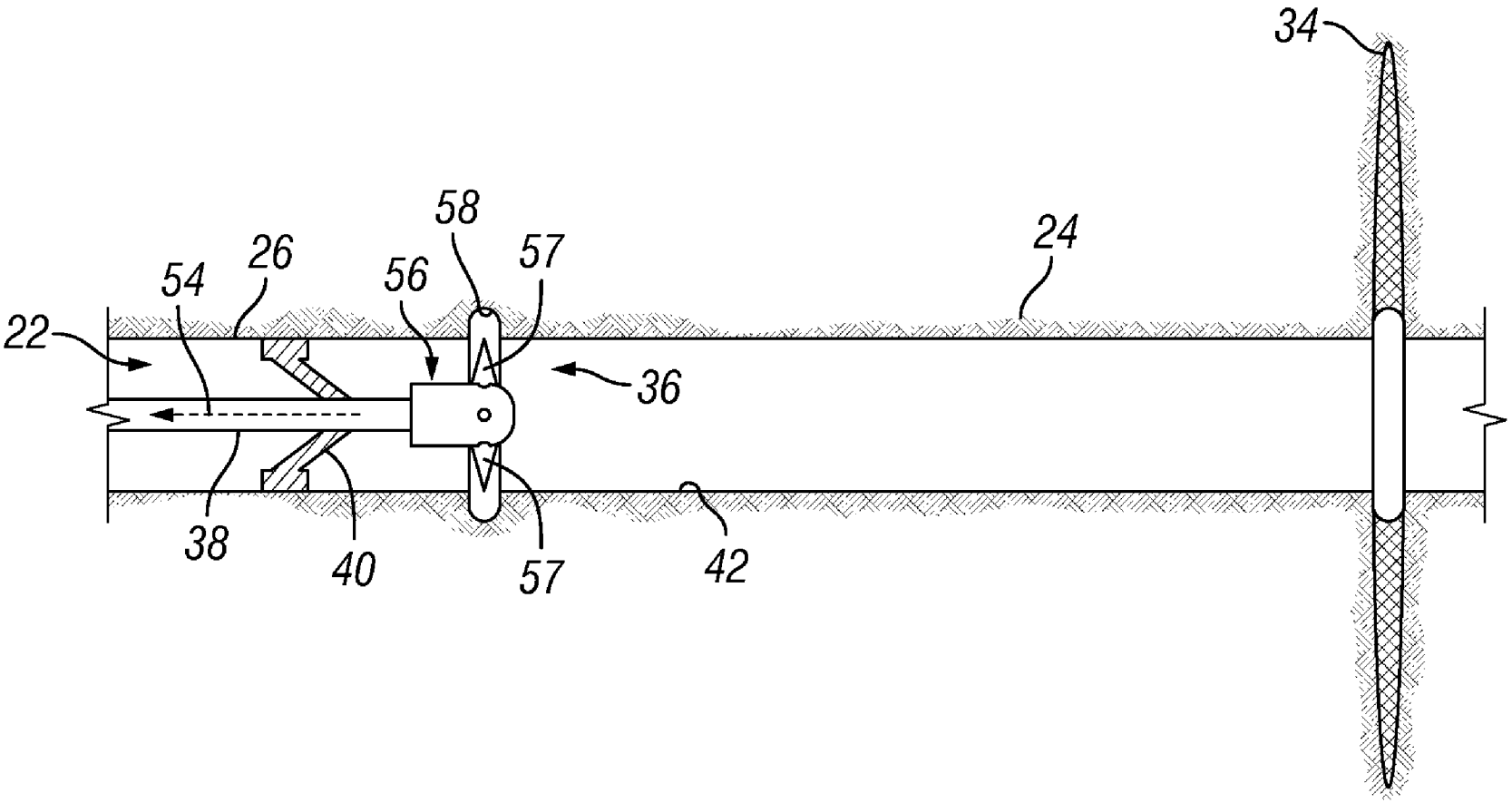
FIG. 6 is an illustration similar to that of FIG. 4 but showing the formation of multiple transverse fractures, according to an embodiment of the present invention.

Regardless of the specific embodiment of stress device 36, an initial fracture 34 grows orthogonally or transversely to the wellbore, e.g. horizontal wellbore section 26, as illustrated in FIG. 6. The stress device 36 is then disengaged or un-set and moved along the wellbore, e.g. pulled back uphole, to the subsequent desired location for creation of a another transverse fracture. The stress device 36 is then reset/reengaged with the surrounding wellbore wall 42, and a subsequent transverse fracture is initiated, as illustrated in FIG. 6. This process can be repeated as many times as desired along the section of wellbore being fractured to create multiple orthogonal fractures. For example, in some applications 15 or more orthogonal fractures can be formed at precisely controlled locations at intervals of less than approximately 100 feet/30 m along a horizontal section of wellbore.

Figure 7:
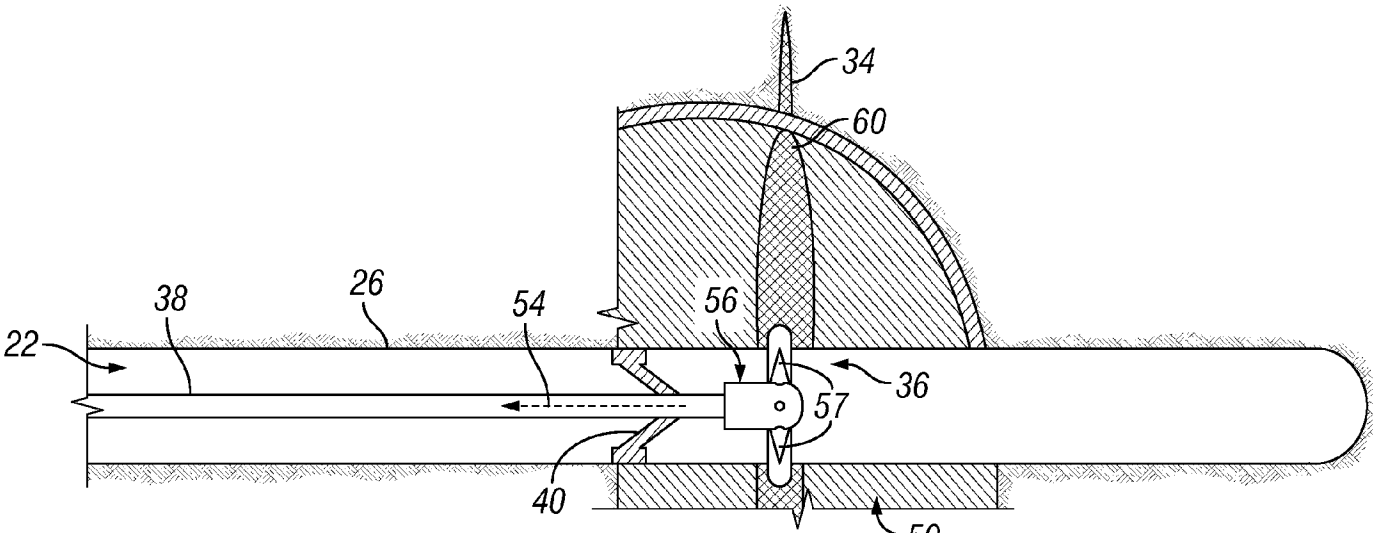
FIG. 7 is an illustration similar to that of FIG. 4 but showing the use of one embodiment of the stress device to create an enhanced, induced fracture, according to an embodiment of the present invention.

In many applications, notch 58 can be used in combination with reduced stress region 50 to greatly decrease the fracture initiation pressure and to further control initiation of the induced fracture at the intended location. Additionally, the stress reduction also can be used to increase the width of the transverse induced fracture in a near wellbore area to create a width enhanced induced fracture region 60, as illustrated in FIG. 7. In a cased and cemented wellbore, the stress reduction also reduces or eliminates near wellbore complexities and tortuosities and thereby reduces or eliminates early terminations due to near wellbore bridging. As result, near wellbore pressure drops are greatly reduced during production.

Figure 8:
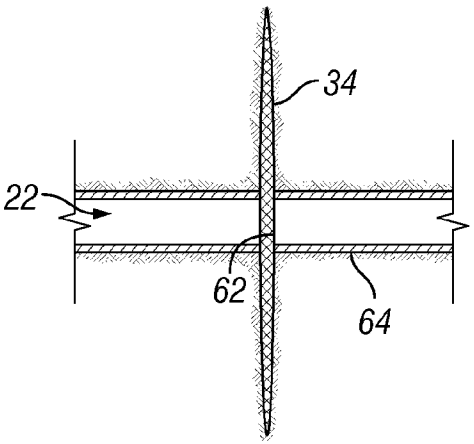
FIG. 8 is a schematic illustration showing the formation of a transverse fracture through a casing, according to an alternate embodiment of the present invention.

Use of jetting tool 56 facilitates placement of the desired transverse fractures regardless of whether the wellbore is cased and cemented. By cutting a slot 62 through a wellbore casing 64, as illustrated in FIG. 8, and then creating the reduced stress region 50, a clean, planar, transverse fracture 34 can be created. The controlled creation of such transverse fractures eliminates near wellbore friction and production constriction. Consequently, stress device 36 enables precise control over the creation of transverse fractures in many types of wellbores, including open hole wellbores and cased wellbores.

As described above, well system 20 may be constructed in a variety of configurations for use in many environments and applications. The stress device 36 may be constructed with a single stress manipulating mechanism or a plurality of stress manipulating mechanisms. Additionally, the stress device 36 can be constructed with reciprocating anchors, slips or other mechanisms for engaging the surrounding wellbore wall. Furthermore, the stress device 36 can be constructed with or without jetting tool 56, and the jetting tool can be combined with single or multiple stress manipulating mechanisms. The jetting tool 56 also can be formed in a variety of configurations with many types of components. Furthermore, many types of fracturing systems and fracturing fluid flow passages can be used to deliver the fracturing fluid used in creating the desired fractures.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of treating a well, comprising:

deploying a device into a wellbore;

engaging a wall of the wellbore with the device;

manipulating the device to create a reduced stress region in a formation; and fracturing the formation at the reduced stress region;

wherein deploying comprises deploying the device into a horizontal section of the wellbore, and wherein manipulating comprises separating a pair of device mechanisms to create a reduced stress region in the formation between the pair of device mechanisms, while simultaneously creating increased stress regions in the formation outside of the pair of device mechanisms.

2. The method as recited in claim 1, wherein engaging comprises repeatedly engaging the wall at specific locations along the horizontal section to create fractures at the specific locations.

3. The method as recited in claim 1, wherein manipulating comprises separating a pair of opposing anchors engaging the wall.

4. The method as recited in claim 3, further comprising releasing the pair of opposing anchors and reengaging the wall at additional locations to create fractures at multiple selected locations along the horizontal section.

5. A method, comprising:

deploying a stress device into a generally horizontal section of a wellbore via tubing;

engaging the stress device with a surrounding wall; and manipulating the stress device to create a reduced stress region at a desired location in a formation along the horizontal section to enable controlled creation of a transverse fracture in the formation at the desired location;

wherein manipulating comprises any one of separating the slips to create the reduced stress region in the formation, pulling on the device with the tubing to create the reduced stress region, using a jetting tool to cut into the surrounding wall to create a weakened area in the reduced stress region, or using a jetting tool to cut through a casing and into the formation to create a weakened area in the reduced stress region.

6. The method as recited in claim 5, further comprising moving the stress device along the horizontal section and forming transverse fractures at multiple selected locations along the horizontal section.

7. The method as recited in claim 5, wherein engaging comprises engaging a pair of slips with the surrounding wall when manipulating comprises separating the slips to create the reduced stress region in the formation.

8. A system, comprising:

a tubing;

a stress device mounted to the tubing for movement along a wellbore, the stress device having a mechanism able to engage and the grip a wellbore wall, wherein the stress device can be manipulated to create a reduced stress region at a selected location in a formation; and a fracturing system to create a transverse fracture in the formation;

wherein the stress device comprises:

i) two sets of retractable anchor arms that can be separated to create the reduced stress region; or ii) a single set of retractable anchor arms and a rotary jetting tool.

9. The system as recited in claim 8, wherein the tubing comprises coiled tubing.

10. A method, comprising:

selecting multiple fracture locations along a generally horizontal section of a wellbore;

delivering a stress device downhole into the wellbore;

utilizing the stress device to create a reduced stress region in the formation at a first fracture location of the multiple fracture locations;

fracturing the formation at the reduced stress region created at the first fracture location; and moving the stress device to sequentially create reduced stress regions and to fracture the formation at the reduced stress regions for each fracture location of the multiple fracture locations.

11. The method as recited in claim 10, wherein utilizing comprises using the stress device to create opposing forces along a wall of the wellbore.

12. The method as recited in claim 10, wherein utilizing comprises engaging the stress device with a wall of the wellbore and pulling on the device with a tubing.

13. The method as recited in claim 10, further comprising cutting into a wall of the wellbore at each reduced stress region to facilitate fracturing.

14. A method of treating a well, comprising:

deploying a device into a wellbore;

engaging a wall of the wellbore with the device;

manipulating the device to create a reduced stress region in a formation; and fracturing the formation at the reduced stress region;

wherein deploying comprises deploying the device into a horizontal section of the wellbore, and wherein manipulating comprises pulling on the device with a tubing while the device is engaged with the wall to create the reduced stress region.

15. The method as recited in claim 14, wherein manipulating further comprises using a jetting tool to cut into the wall and create a weakened area in the reduced stress region.

16. The method as recited in claim 15, further comprising resetting the device and pulling on the device at a plurality of locations along the horizontal section to create fractures at multiple selected locations.

* * * * *